United States Patent [19]

Soulant, Jr.

[11] 3,957,010

[45] May 18, 1976

[54] STABILIZATION SYSTEM FOR WATER VEHICLES, PLATFORMS, AND STRUCTURES IN WIND-MAINTAINED SEAS

[76] Inventor: Herman A. Soulant, Jr., 501 Gilscot Place, Rockville, Md. 20851

[22] Filed: Aug. 29, 1975

[21] Appl. No.: 608,857

[52] U.S. Cl. ..... 114/123; 114/.5 D

[51] Int. Cl.[2] ..... B63B 43/14

[58] Field of Search ..... 114/.5 D, .5 R, 43.5 R, 114/43.5 AC, 123, 124, 125, 126, 66.5 H; 61/46, 46.5, 5; 175/5, 7, 9

[56] References Cited

UNITED STATES PATENTS

| | | | |
|---|---|---|---|
| 1,715,028 | 5/1929 | Blood | 114/123 |
| 2,889,795 | 6/1959 | Parks | 114/.5 D |
| 3,734,220 | 5/1973 | Smith | 61/46.5 |
| 3,762,352 | 10/1973 | Brahtz | 114/.5 D |
| 3,800,601 | 4/1974 | Soulant, Jr. | 73/170 A |
| 3,815,536 | 6/1974 | Duc | 114/.5 D |

*Primary Examiner*—Trygve M. Blix
*Assistant Examiner*—Jesus D. Sotelo
*Attorney, Agent, or Firm*—R. S. Sciascia; Q. E. Hodges; D. McGiehan

[57] ABSTRACT

A device for stabilizing a floating platform or the like from the roll or heave motions, imparted by wind-maintained waves and regular swells. The platform is supported on a plurality of buoyant pontoons horizontally spaced a variable distance apart in the direction of the wave system. Once the significant wavelength is approximated, the buoyant pontoons are moved to a spacing of a wavelength, of the significant wave, and then continually adjusted to the possibly changing wavelength of the significant wave. These spacing, controlled from the wave system, stabilize the platform because such spacing insures that the lifts from all pontoons at each instant in time are equal.

6 Claims, 2 Drawing Figures

STABILIZATION SYSTEM FOR WATER VEHICLES, PLATFORMS, AND STRUCTURES IN WIND-MAINTAINED SEAS

The invention described herein may be manufactured and used by or for the Government of the United States of America for governmental purposes without the payment of any royalties thereon or therefor.

BACKGROUND OF THE INVENTION

An all too well known problem with any floating object, be it a buoy, vehicle, platform, or structure, is its tendency to pitch, heave, roll, and yaw in responce to the motion of the sea, such as waves and swells, which may or may not be induced by the wind. These motions are normally defined as follows: pitch is a fore-to-aft change in horizontal orientation of the body; heave is a total vertical displacement of the body; roll is a side-to-side change in horizonatal orientation; and yaw is the horizontal azimuthal side-to-side rotation of the vehicle. Unfortunately all these motions of a buoyant platform are combined into a complex motion having the elements of all four distinct motions, and obviously it would be desirable to eliminated them all.

When the wave system, giving rise to the motions on the platform, are wind induced, the wave length can be determined by known methods such as accelerometers and other measuring devices (see for example, U.S. Pat. No. 3,800,601 to the inventor, disclosing a theory of wind-maintained seas and methods of measuring same). The fact that a wave system is generally predictable, permits detection of the wave length and then compensation for the motion created on a buoyant platform, vessel, or the like. It is not practical to compensate for wave patterns that are not predictable in wavelength, such as are developed from unknown distant disturbances.

It is desirable to stabilize a floating platform for many reasons and applications, such as for off-shore oil drilling, in oceanography as for taking bottom samples, ocean floor surveying, and recovering objects from the ocean floor. Other recent military considerations for the use of floating platforms are floating islands and landing fields or runways with their necessary ancillary facilities and equipment.

The prior art shows floating islands or sea platforms that may or may not be stabilized, and of course, many that are secured to the ocean floor. The stabilized platforms of the prior art involve the use of elements, buoyant or otherwise, capable of deforming vertically to absorb the rise and fall of the waves under the platform. These devices suffer from the disadvantage that they only attenuate the response of the platform to the wave disturbances. They do not decouple the disturbance so as to remove it.

SUMMARY OF THE INVENTION

Briefly, the instant invention overcomes the disadvantages of the prior art by providing a stabilization system for floating platforms, vehicles, and structures in wind-maintained open seas which decouples the disturbance from the platform. The most generalized form of the invention will comprise a platform having a plurality of buoyant pontoons mounted on the underside of, and in lateral movable relationship with the platform. Suitable rails and wheels, as well as drive motors, gears and screws are provided to power the motion of the pontoons. Accelerometers, generally measuring the vertical component, are placed on the platform, usually one or more at the approaching wave end and one or more at the receding wave end. It should be understood at this point, that the platform, vessel or the like, is allowed to "broach-to" the wave system. While a "broached-to" orientation is considered undersirable in most cases, it is an orientation that is "stable," that is, it is commonly known that any floating object will remain "broached-to" without any outside forces applied. Also, while a propulsion system might be added, the vessel still would be maintained "broached-to" the wave system. In operation, the accelerometers, through an associated electronic system, and by comparison with the instant pontoon spacing, measure the wavelength of the wind-maintained wave system. The electronic system is connected to the motor's screw drive that are connected to the pontoons. The pontoons are then moved to, and are then continually adjusted to a distance apart equal to the wavelength of the wave system. As will be explained hereinafter, adjusting the pontoon distance to the wavelength stabilizes the platform in roll. It is to be understood that the invention is also applicable to situations where the pontoons may be adjusted to integer multiples of the wavelength of the significant wave.

OBJECTS OF THE INVENTION

Accordingly, an object of the present invention is to provide a new and improved stabilization system for platforms, vehicles, and structures in the open seas.

Another object is to provide a platform stabilized in roll when said platform is "broached-to".

A further object of the present invention is to provide a stabilization system for platforms in open wind-maintained seas.

A still further object is to provide a roll stabilized platform in wind-maintained seas that can measure and be tuned to the on-coming wave system.

BRIEF DESCRIPTION OF THE DRAWINGS

A more complete understanding of the invention and many of the attendant advantages thereto will be readily appreciated as the same become better understood by reference to the following detail description when considered in connection with the accompanying drawings, wherein.

DESCRIPTION OF THE PREFERRED EMBODIMENT

Figure 1:
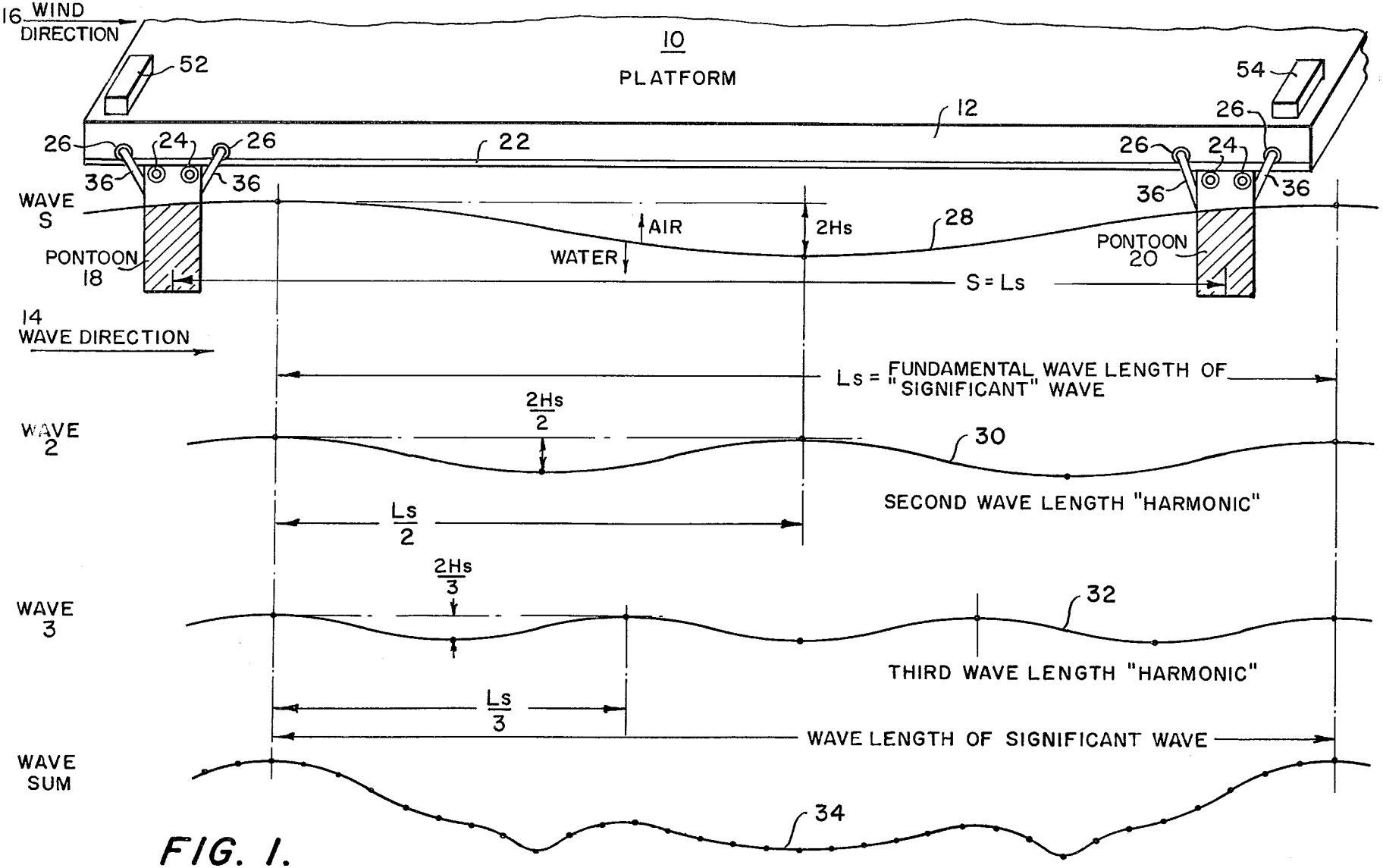
FIG. 1 is a view of the generalized form of a stabilized platform "broached-to" in the wave system, and showing a plurality of waveforms striking the platform.

Referring now to the drawings wherein like reference numerals refer to the same parts throughout the several views, there is shown in FIG. 1 the most generalized form of a floating platform 10. The members connecting pontoons 18 and 20 of platform 10 are referred to as a cross-structure 12. The broad-side of the pontoons are facing the approaching wave system 14 and wind system 16, both depicted by arrows. Attached to the bottom-side of the platform 10 is the approaching-wave pontoon 18 and the receding-wave pontoon 20 in a movable relationship along the platforms as by rails 22, (one shown) and wheels 24 and 26, to be discussed in further detail hereinafter.

Below the floating platform 10, are representations of a plurality of sinusoidal wave forms that might be seen by the stabilized platform. From top to bottom, the first wave, 28, denoted as "wave S", is the "significant" or fundamental wave-length wave. The second 30, denoted as "wave 2", is the second wavelength or "harmonic" of the first. The third 32, denoted as "wave 3", is the third wavelength or "harmonic" of the first fundamental. To the first order, these three components comprise a wind-maintained wave system. The fourth and last waveform 34 denoted "wave sum", is the summation of the three wave forms shown above, that is, the fundamental plus the second harmonic plus the third harmonic. It is to be noted that the wave forms are taken at "an instant in time", and their structure, wavelength, and heights are proportionally scaled to real life. Further, it is to be noted that all the wave forms, including the summation wave form peak at the same position which is shown offset from both pontoons 18 and 20 the same amount at this "instant of time". Note also, the height of the significant wave ($H_s$) is shown, but the peak-to-crest, (really Peak—Peak in common usage) is indicated as $2H_s$. In actuality and as indicated, the second harmonic height is 2Hs/2, and the third harmonic height is 2Hs/3. The fourth or summation wave is graphed to show its instant complex waveshape with real height (H) and wavelength (L) in relationship to the waveforms above it.

Note, that although the three sinusoidal components are present at all times, their relative propogation speed, and therefore position with respect to each other, are different with time, the symmetry about the pontoons remains.

Figure 2:
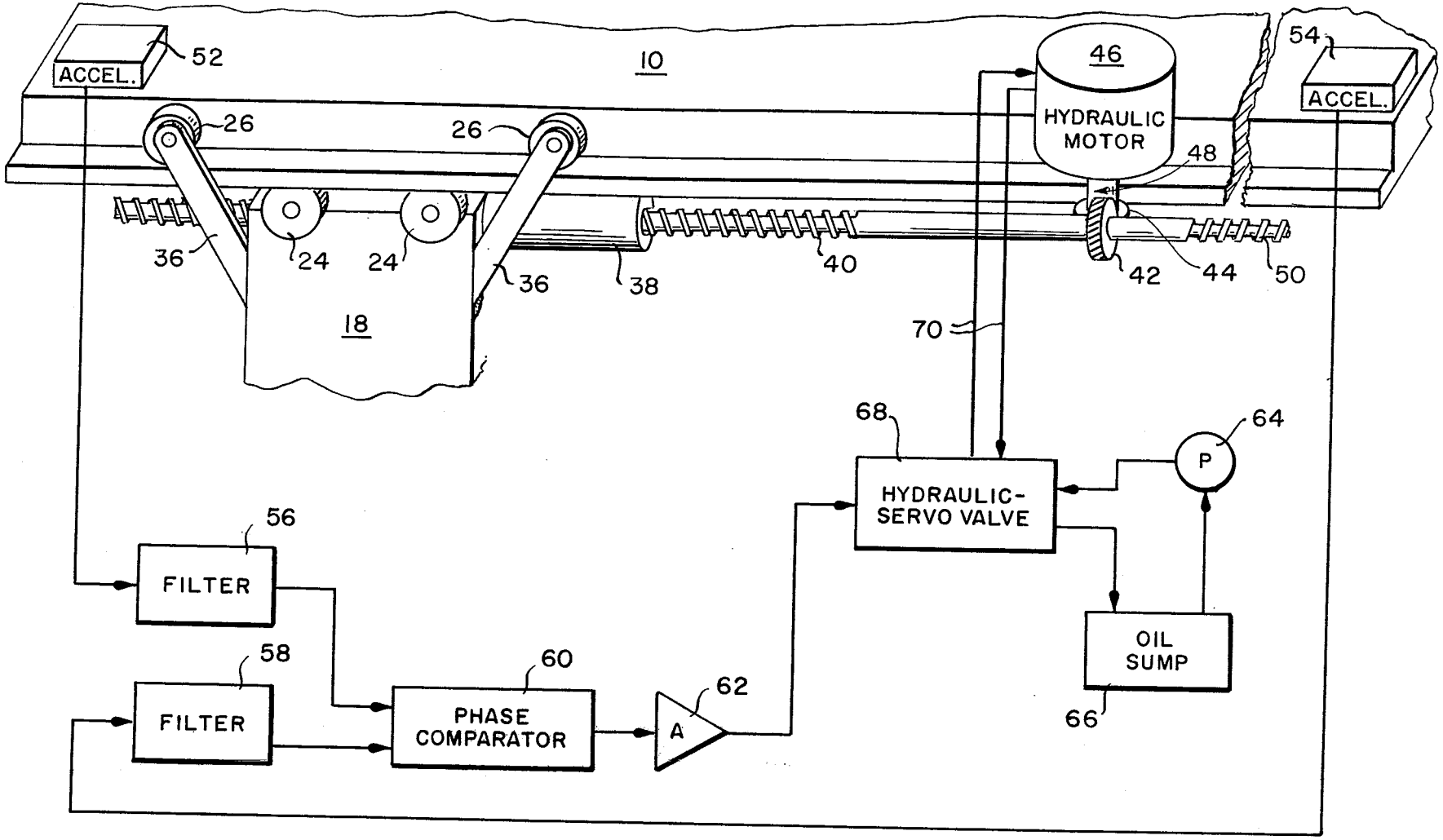
FIG. 2 is a view taken in the same direction as FIG. 1, showing the details of the movable pontoon structure, and a block diagram of the electronic system for moving said pontoons to proper positions.

Referring now to FIG. 2, an embodiment of movable buoyant pontoons (18 shown for convenience) on the generalized form of the platform 10 is shown in detail. Rails 22 may be an inverted "T" beam or "I" or the like but here a "T" beam is shown. As shown generally in FIG. 1, the pontoon 18 has load bearing wheels 24 affixed for rotation thereon and rolling against the bottom of the flange of the inverted "T". Secured to the pontoon 18, as by welding, are a pair of angularly and upwardly outstretched arms 36. At the distal end of each arm, affixed for rotation is an idler torsion wheel 26 rolling against the upper side of the flange of the inverted "T". This arrangement and combination of wheels allows translation of the pontoons 18 and 20 along the bottom of the cross-structure 10 and prevents rocking of the pontoons. Secured to each pontoon 18 and 20 is a traveling nut 38, threadably engaged on a long lead screw 40. A worm gear 42 is secured to the lead screw 40 for rotation thereof, and a worm 44 is engaged by its teeth to the peripheral teeth of the worm gear 42 for rotation thereof on non-parallel axes. A motor 46 (electric or hydraulic) has a rotatable output shaft 48 secured to the worm 44. To the right (as shown in FIG. 2) of, and secured to the worm gear 42 is another lead screw 50, similar to lead screw 40 but having threads of the opposite hand. This lead screw 50 engages the travelling nut (not shown) of the pontoon 20. Thus there is formed a turnbuckle type action capable of changing the spacing of the pontoons, and it represents only one possible arrangement, but other embodiments such as a rack and pinion could readily be used.

Referring to FIG. 1 and FIG. 2 the control of the motor 46 will be discussed. On the cross-structure 10 is shown mounted an accelerometer 52 near pontoon 18 and another accelerometer 54 near pontoon 20, which measure vertical accelerations. As is best shown in FIG. 2, the outputs of accelerometers 52, 54 are directed to a separate filter 56 and 58. The filtered signals are directed to a phase comparator 60, the output of which is connected to an amplifier 62. If motor 46 is a hydraulic motor, a hydraulic system comprising a pump 64, an oil sump 66, and a hydraulic-servo valve 68 is connected to the motor 46 via conduits 70. The output of amplifier 62 is connected to and controls the hydraulic motor. If an electric reversible motor were used, obviously the hydraulic system could be eliminated.

In operation, as discussed above, the floating platform naturally will assume a "broached-to" position in the wave system direction as shown in FIG. 1. Therefore the roll component is what will be compensated for and controlled. The accelerometer 52 measures the vertical acceleration of the approaching waves and the accelerometer 54 measures the vertical acceleration of the receding waves. The output of each accelerometer is filtered to obtain the desired frequency band-width by filters 56, 58 and their signals are phase compared in the comparator 60, which signal is merely amplified in amplifier 62. The output current of the amplifier will be proportional to the phase difference obtained originally from the accelerometers. Obviously when both accelerometers have the same acceleration the pontoons 18, 20 will be seeing the same displacement of water at one instant of time as the wave system flows by. Stated another way, the displacement volume of pontoon 18 will equal that of pontoon 20, as long as their separation "S" equals the wavelength of the significant wave "$L_s$". This pontoon separation where $S-L_s$ is achieved by the accelerometers, 52, 54 electronic circuits 56, 58, 60, 62, the hydraulic system 64, 66, 68 acting on motor 46. The motor then drives the leadscrews 40 and 50 to move the pontoons 18, 20 to the desired adjusted position where the accelerations are the same. Thus a floating platform, vehicle, or structure is stabilized in open wind-maintained seas.

Obviously, numerous modifications and variations of the present invention are possible in light of the above teachings. It is therefore to be understood that, within the scope of the appended claims, the invention may be practiced otherwise than as specifically described.

What is claimed is:

1. A stabilization system for water vehicles, floating platforms, structures having buoyant pontoons in wind-maintained seas comprising:

means for measuring the wavelength of the significant wave in an oncoming wind-maintained wave system in the open sea; and means for laterally adjusting buoyant pontoons on said platform to a spacing corresponding to the wavelength of said significant wave.

2. The stabilization system of claim 1 wherein said means for measuring the wavelength of the significant wave further comprises:

an accelerometer for measuring the vertical accelerations of an approaching wave; and an accelerometer for measuring the vertical accelerations of a receding wave.

3. The stabilization system of claim 2 wherein said means for adjusting said buoyant pontoons further comprises:

an electronic circuit connected to and comparing the phase difference output of said accelerometers;

a motor control system connected to receive the output of said electronic circuit;

a motor connected to said control system and responsive hereto; and a gear arrangement connected between said motor and said pontoons for adjusting the spacing thereof.

4. The stabilization system of claim 3 wherein said electronic circuit further comprises:

a low bandpass filter connected to each accelerometer;

a phase comparator connected to the output of said filters for comparing the phase relationship; and an amplifier connected between said phase comparator output and said motor control system.

5. The stabilization system of claim 4 wherein said motor control system and said motor comprise:

a hydraulic pressure system; and a hydraulic motor.

6. The stabilization system of claim 5 wherein said gear arrangement further comprises:

a worm connected to said motor;

a worm gear meshed with said worm;

a lead screw secured to said worm gear for rotation therewith; and a traveling nut connected to each pontoon and meshed with said lead screw;

whereby upon actuation of the motor in one direction moves the pontoons closer together, and in the other direction moves the pontoons further away to adjust the spacing to equal the wavelength of the significant wave.

* * * * *